United States Patent [19]

Milicic

[11] 3,982,762

[45] Sept. 28, 1976

[54] OUTDOOR GAME DART

[75] Inventor: Tony Milicic, Don Mills, Canada

[73] Assignee: Irwin Toy Limited, Toronto, Canada

[22] Filed: June 5, 1975

[21] Appl. No.: 583,925

[52] U.S. Cl. ..... 273/106.5 B

[51] Int. Cl.[2] ..... A63B 65/02

[58] Field of Search ..... 273/106.5 B, 106.5 R, 273/106 R, 106 A; 33/392, 398

[56] References Cited

UNITED STATES PATENTS

| | | | |
|---|---|---|---|
| 980,025 | 12/1910 | Titus | 272/84 |
| 1,651,499 | 12/1927 | Woodrow | 273/106.5 D |
| 1,789,575 | 1/1931 | Allen | 273/106.5 B |
| 2,791,037 | 5/1957 | Damron | 33/392 X |
| 3,596,910 | 8/1971 | Rizzo | 273/106.5 R |

FOREIGN PATENTS OR APPLICATIONS

| | | | |
|---|---|---|---|
| 579,837 | 7/1958 | Norway | 33/392 |
| 80,971 | 11/1952 | Norway | 273/106.5 R |
| 17,363 | 12/1915 | United Kingdom | 273/106.5 R |

*Primary Examiner*—Paul E. Shapiro

*Attorney, Agent, or Firm*—David W. Wong; Arne I. Fors

[57] ABSTRACT

This invention relates to a lawn dart which has an overall weight considerably lighter than metal head lawn darts. The weight of the dart is concentrated at its front head member such that it always provides a desirable flight and trajectory. The dart is comprised mainly of two component parts namely an integral flight shaft portion and a head member mounted at the front end of the shaft. The dart is made of light-weight impact resistant plastics by moulding. The head member is a hollow shell filled with a weighting material such as sand.

6 Claims, 2 Drawing Figures

OUTDOOR GAME DART

BACKGROUND OF THE INVENTION

This invention relates to outdoor field game darts or javelins and particularly relates to a heavy weighted head member for such darts.

Outdoor field game darts or javelins are well known and are commonly called lawn darts. Such darts are generally similar in structure to indoor game darts but are of a relatively larger size. Lawn darts are played on an outdoor field in which a target area is established on the ground and the players throw the darts from a selected distance in order that the darts would fall and thrust in the ground within the target area. Lawn darts must necessarily be strong in structure since they are subject to a large amount of punishment even under normal use; yet they must be simple in structure such that they can be easily and economically manufactured on a commercial scale.

Common lawn darts have a solid metal cylindrical head member for providing the required heavy weight at the front end therein. A pointed metal pin is mounted in the front end of the head member for thrusting into the ground and an elongated metal rod is secured to the rear end of the head member for mounting the flight. The flight is a plastic hollow sleeve having three vanes provided thereon. The sleeve can be slidably engaged over the elongated metal rod to mount the flight on the rod and it is secured in place by a nut mounted on the free end of the metal rod. Such dart has a strong structure and operates satisfactorily. However, it is relatively expensive and time consuming to manufacture which is mainly due to a large amount of metal being required in making the dart. Furthermore, the metal component parts must be made in separate manufacturing steps. Usually, the head member is first formed and then bores are drilled in the center of the front and back ends therein. The pin and the elongated rod are forcibly secured in the respective bores. These component parts may be damaged during such force-fitting resulting in wastage of material. Furthermore, the bores must be accurately formed in order that the pin and the rod can be properly and fixedly secured therein such that they would not become disengaged under the high impact during use.

The pin and the elongated rod can be mounted by heating the head member to expand the bores and engaging the pin and the rod in the respective expanded bores and subsequently cooling the head member such that the pin and the rod are fixedly mounted to the head member. It can be appreciated that such process is time consuming to carry out and is not commercially economical for adaptation on a continuous mass production scale.

Another drawback of a metal dart is that the weight of the dart is not concentrated at the head member. This is due to the weight of the elongated metal rod for mounting the flight vanes being almost equal to the head member. Thus, the dart may not provide a desirable trajectory with the pin pointing downward in the falling state of the dart. This results in the dart falling to the ground without the pin thrusting into the ground. This drawback may be overcome by increasing the size of the head member. However, this would invariably increase the bulkiness of the dart and the amount of metal used and, accordingly, would increase the cost of manufacturing. Additionally, the total weight of the dart is unnecessarily heavy such that it is hazardous if it accidentally falls upon the players or other persons in the vicinity of the playing area.

PURPOSES OF THE INVENTION

It is a principal object of the present invention to provide a lawn dart which has an overall light weight with all its weight concentrated at its head member.

It is an object of the present invention to provide a lawn dart which can be produced with low cost in a continuous mass production scale.

It is another object of the present invention to provide a head member for lawn darts which can be manufactured by a mass production method.

It is yet another object of the present invention to provide a lawn dart which has a simple structure and yet is strong enough to withstand the considerable amount of punishment under normal use.

It is still another object of the present invention to provide a lawn dart which has few component parts and is easy to assemble so that damaged parts may be replaced.

BRIEF DESCRIPTION OF DRAWINGS

Other objects of this invention will appear in the following description and appended claims, reference being made to the accompanying drawings forming a part of the specification wherein like reference numerals designate corresponding parts in the several views.

SUMMARY OF THE INVENTION

Figure 1:
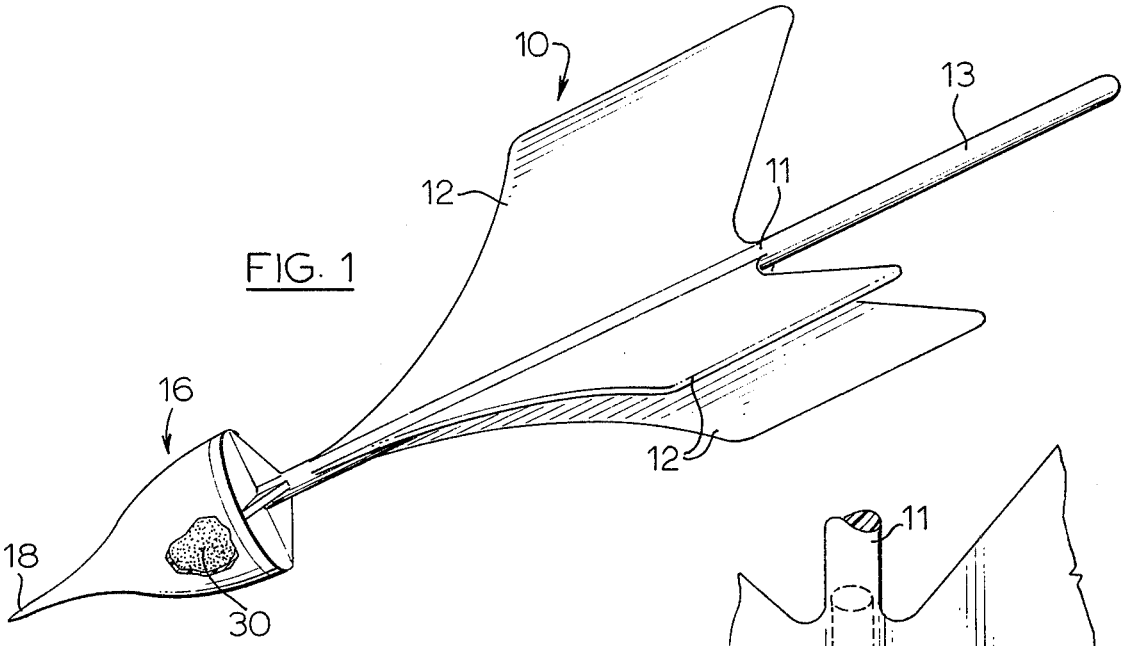
FIG. 1 is a perspective view of the lawn dart according to the present invention.
Figure 2:
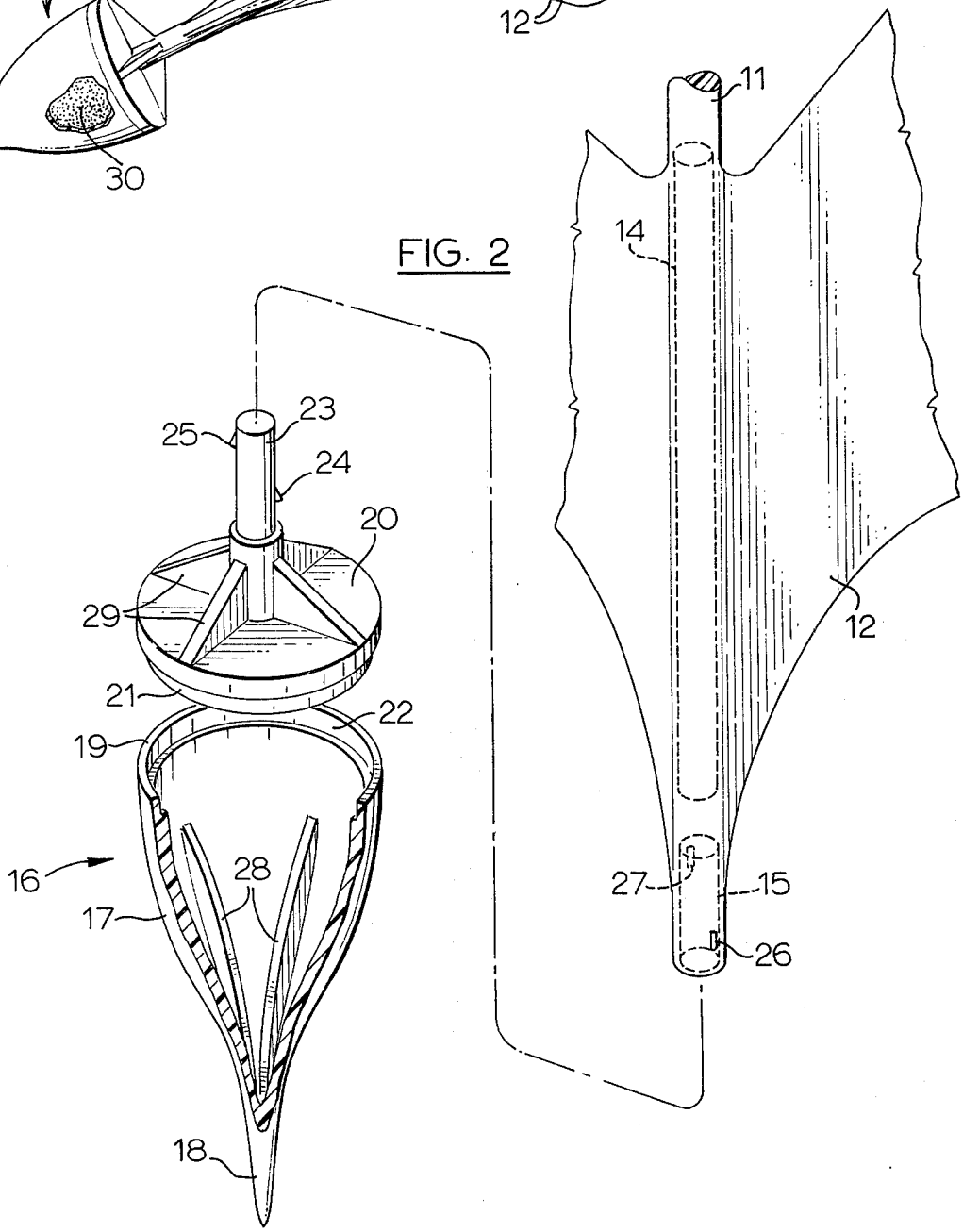
FIG. 2 is a partial cutaway exploded view showing the shell structure of the head weight member and the flight.

The head member for an outdoor dart according to the present invention comprises a substantially conical hollow shell having an elongated pointed front tip and a rear opening, a cover member adapted for covering said rear opening, said cover member having a central mounting pin extending outwardly from its outer surface and being adapted for mounting said head member on an elongated shaft of said dart.

The shell is filled with a weighting material such as sand so as to provide the heavy weight required in the head member.

DESCRIPTION OF THE PREFERRED EMBODIMENT

Referring to the drawings, the preferred embodiment of the dart according to the present invention has a flight portion 10 including an elongated shaft 11 having three flight wings or vanes 12 formed thereon in an evenly spaced manner. Three vanes are shown in this preferred embodiment; however, it can be appreciated that any suitable number of vanes may be used. The shaft 11 and the vanes 12 may be made as an integral unit with an impact resistant plastic material by a continuous moulding process.

The shaft 11 has an elongated rear end portion 13 extending outward beyond the rear ends of the vanes. This rear end portion 13 provides a grip on the shaft for the player to hold the dart in playing the game.

The shaft is preferrably reinforced by a rigid rod 14 embedded in the portion therein adjoining the vanes. The reinforcement provides more rigidity to the shaft.

A sleeve portion 15 is provided at the front end of the shaft 11.

The front end weighted head member 16 of the dart comprises a substantially conical hollow shell 17 also made of an impact resistant plastic material and it has an integral pointed front tip 18 and a rear opening 19. The front tip 18 provides the means of thrusting into the ground.

The rear opening 19 is sealable by a cover 20 which has a reduced portion 21 engageable with a rim portion 22 formed at the opening 19. The cover 20 and the rear end of the shell 17 have an equal diameter such that weighted head member has a continuous smooth side wall as best shown in FIG. 1.

The cover 20 has a central mounting pin 23 formed on its outer surface and extending outwardly from its centre. The pin 23 is slidably and snugly engageable in the sleeve portion 15 at the front end of the shaft 11 for mounting the head member on the shaft. Two barbs 24 and 25 are provided on the pin 23. These barbs have a gradually sloping side to facilitate the insertion of the pin into the sleeve and a truncated side. The barbs will be received in two retaining openings 26 and 27 respectively when the pin is fully inserted into the sleeve. The retaining openings 26 and 27 co-act with the truncated side of the barbs 24 and 25 respectively to prevent accidental regression of the pin under the high impact in normal use. The barbs are formed in an offset manner on opposite sides of the pin to provide an even force distribution.

It will be understood by those skilled in the art that the barbs 24 and 25 and the associated retaining openings 26 and 27 are shown as a preferred form of providing means of securing the head member 16 securely onto the shaft 11. Other means such as step-like ridges may be formed on the pin and the inside wall of the sleeve such that they co-act to retain the pin securely in the sleeve.

A plurality of reinforcing longitudinal ridges 28 may be formed in the inner side wall of the conical shell 17 to provide more strength to the shell such that it would withstand considerable impact without breaking.

A plurality of radial ridges 29 may be formed on the cover for strengthening the pin 23. The radial ridges prevent the pin from any pivotal movement so that the pin would not break or shear off from the cover due to the high impact force during normal use of the dart.

The shell 17 is filled with a weighted material 30 such as sand as best shown in a broken section in FIG. 1. Sand is used because of its low cost and availability; other materials such as metal powder, pellets or the like may be used.

The cover 20 after being secured to the opening 19 may be sealed therein by well known methods such as sonic or heat seal so that the cover would not dislodge from the shell under normal impact.

It will be appreciated that since all the components of the dart of the present invention are made of plastic, the dart has a relatively light overall weight. The combined weight of the plastic components is negligible compared to the weight of the weighting material. Thus, the total weight of the dart is entirely concentrated at the head member to provide a desirable flight with the tip thrusting into the ground at the end of the trajectory.

While the invention has been particularly shown and described with reference to a preferred embodiment thereof, it will be understood by those skilled in the art that various changes in form and detail may be made therein without departing from the spirit and scope of the invention.

What I desire to protect by Letters Patent of the United States is:

1. In a field game dart having an elongated shaft including a plurality of vanes provided thereon and a weighted head member mounted at the front end of said shaft, said head member comprising a substantially conical hollow shell having an elongated pointed front tip and a rear opening, said shell being filled with a weighting material, a cover member securely mounted over said rear opening, said cover having a central mounting pin extending outwardly from its outer surface, said mounting pin being engageable with a sleeve portion provided at the front end of said shaft for mounting said head member thereon.

2. A head member according to claim 1 wherein said conical shell and said cover member are made of an impact resistant plastic material.

3. A head member according to claim 1, wherein said rear opening of said shell has a rim portion formed in its inside edge portion, said cover having a reduced portion engageable with said rim portion to secure said cover on said rear opening.

4. A head member according to claim 1, wherein said mounting pin has at least two barbs formed thereon and said sleeve portion of said shaft has at least two associated retaining openings formed therein, said barbs and said retaining opening being operative to co-act with one another to prevent accidental regression of said mounting pin when said mounting pin is fully inserted into said sleeve portion.

5. A head member according to claim 4, wherein said shell has a plurality of longitudinal ridges formed on its inner side wall for reinforcing said side wall against high impact during normal use of the game dart.

6. A head member according to claim 5, wherein said cover includes a plurality of radial ridges formed thereon adapted for reinforcing said mounting pin.

* * * * *